US005915361A

United States Patent [19]

Heinz et al.

[11] Patent Number: 5,915,361

[45] Date of Patent: Jun. 29, 1999

[54] FUEL INJECTION DEVICE

[75] Inventors: Rudolf Heinz, Renningen; Roger Potschin, Brackenheim; Klaus-Peter Schmoll, Lehrensteinsfeld; Friedrich Boecking, Stuttgart, all of Germany

[73] Assignee: Robert Bosch GmbH, Stuttgart, Germany

[21] Appl. No.: 09/169,945

[22] Filed: Oct. 13, 1998

[30] Foreign Application Priority Data

Oct. 10, 1997 [DE] Germany ..... 197 44 723

[51] Int. Cl.[6] ..... F02M 37/04

[52] U.S. Cl. ..... 123/467; 123/501; 123/458

[58] Field of Search ..... 123/467, 446, 123/458, 514, 500, 501

[56] References Cited

U.S. PATENT DOCUMENTS

| | | | |
|---|---|---|---|
| 4,603,671 | 8/1986 | Yoshinaga | 123/467 |
| 4,784,101 | 11/1988 | Iwanaga | 123/467 |
| 5,511,528 | 4/1996 | Iwanaga | 123/467 |
| 5,622,152 | 4/1997 | Ishida | 123/467 |
| 5,671,715 | 9/1997 | Tsuzuki | 123/467 |
| 5,711,274 | 1/1998 | Drummer | 123/467 |
| 5,732,679 | 3/1998 | Takahasi | 123/467 |
| 5,771,865 | 6/1998 | Ishida | 123/467 |

*Primary Examiner*—Carl S. Miller

*Attorney, Agent, or Firm*—Edwin E. Greigg; Ronald E. Greigg

[57] ABSTRACT

A fuel device which has a high-pressure fuel source from which a number of fuel injection valves, which are each controlled by a 3-way valve, are supplied with fuel. This 3-way valve has a valve member with a closing body provided with sealing faces that cooperates with valve seats and in addition, in its closed positions, defines pressure-exposed surfaces that produce resulting forces that are active in the respective closed position of the closing body.

8 Claims, 2 Drawing Sheets

FUEL INJECTION DEVICE

BACKGROUND OF THE INVENTION

The invention is based on a fuel injection device. In a fuel injection device of this kind that has been disclosed by WO 95/25888, a 3-way valve is used, with the aid of which the control chamber is connected either solely to the high-pressure fuel source or solely to the fuel return chamber. The actuation of the valve member of this 3-way valve is executed with the aid of an electromagnet. With this known embodiment, according to the control of the 3-way valve, the injection valve member is brought into either the fully open or fully closed position. In this connection, the 3-way valve is embodied so that in a respective closed position, the valve member should be totally free of forces resulting from pressures. To that end, the annular surfaces and the circular surfaces are respectively kept the same size.

OBJECT AND SUMMARY OF THE INVENTION

The fuel injection device has the advantage over the prior art that in each of the respective end positions of its closing body, the valve member, at one of the valve seats, has annular surfaces and circular surfaces of different sizes that are loaded by the high pressure of the high-pressure fuel source, in such a way that the closing member is held in a stable end position against its respective valve seat by means of forces resulting from the pressure loading of these surfaces.

In an advantageous manner, the differential area yielded by the difference in the areas is dimensioned so that the resulting forces in the respective end position of the closing body are no greater than approximately 40% of the forces that can be exerted by the adjusting drive. In a further advantageous embodiment, the second annular surface is smaller than the first annular surface and the first circular surface is smaller than the second circular surface.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
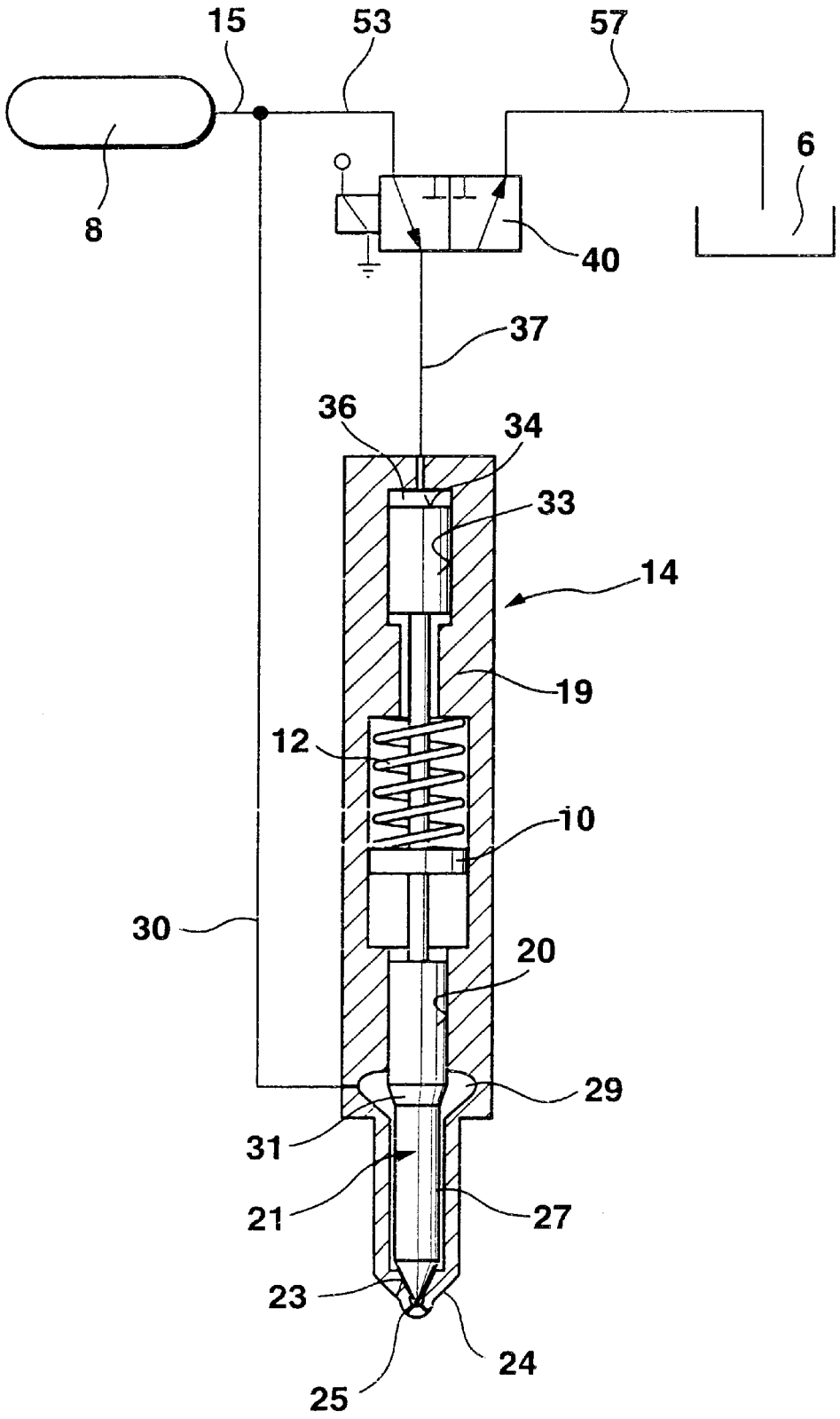
FIG. 1 shows a fuel injection valve of the fuel injection device in a sectional view.
Figure 2:
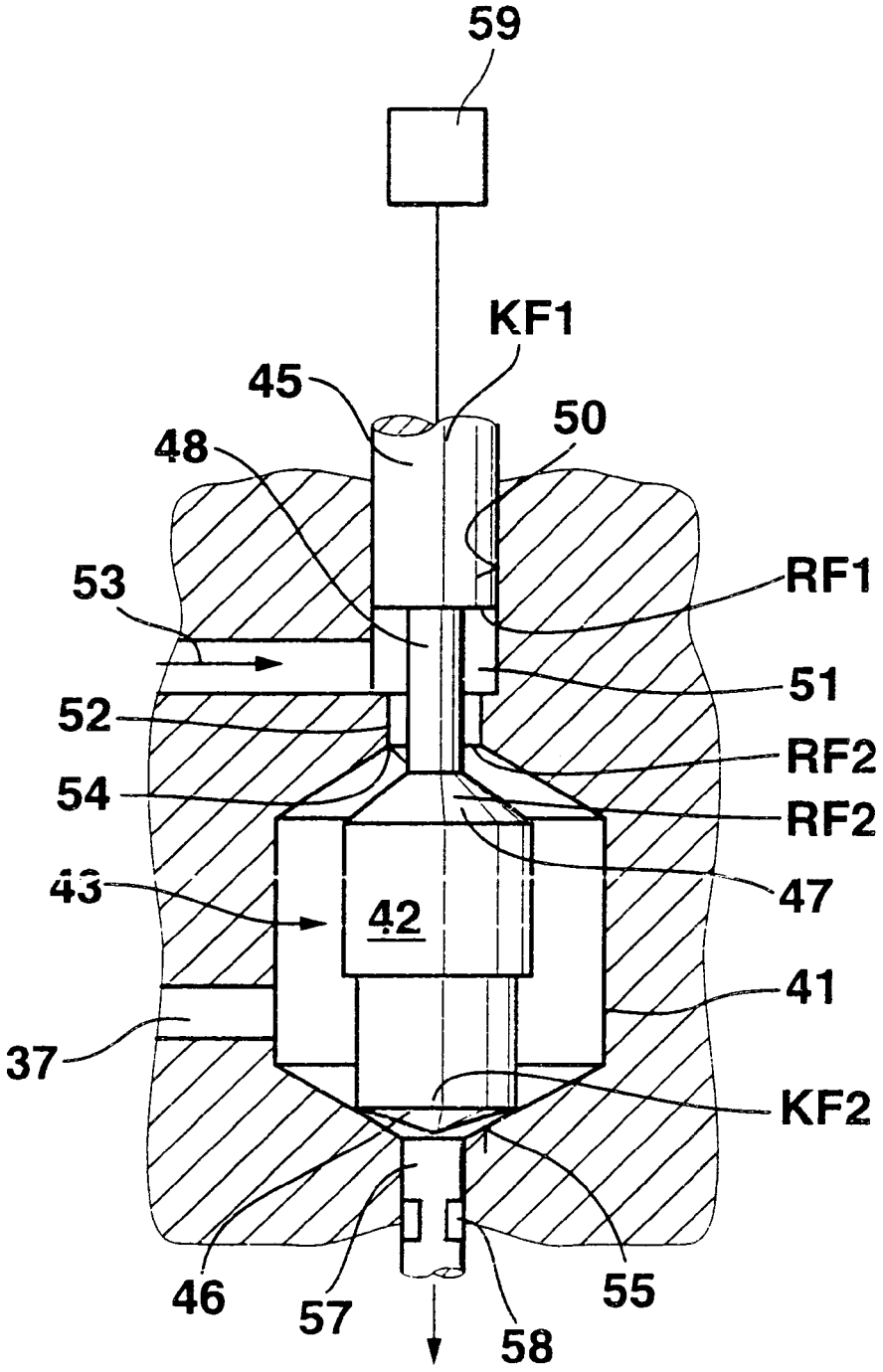
FIG. 2 shows the valve member of the 3-way valve, which valve member controls the fuel injection valve.

The invention relates to a fuel injection device that has a high-pressure fuel pump not shown in detail in the drawing, which receives fuel from a fuel reservoir, if need be with the interposition of a pre-feed pump, and, brought to high pressure, delivers it to a high-pressure fuel reservoir 8 by way of a pressure line. These parts will be called the high-pressure fuel source. By way of fuel lines 15, the high-pressure fuel reservoir 8 supplies each fuel injection valve 14 with fuel brought to at least fuel injection pressure. These fuel injection valves are electrically controlled by a control unit, not shown, so that according to operational parameters of the engine, the opening of the fuel injection valves 14 is determined with the onset of fuel injection and duration of fuel injection.

The fuel injection valve 14 has a housing 19, in which a needle-like injection valve member 21 is guided in a longitudinal bore 20. On its one end, this injection valve member is provided with a conical sealing face 23, which cooperates with a valve seat at the tip 24 of the valve housing that protrudes into the combustion chamber of the engine, and injection openings 25 lead from this valve seat, which connect the interior of the fuel injection valve, in this instance, the annular chamber 27 that encloses the injection valve member 21 and is filled with fuel at injection pressure, to the combustion chamber of the associated engine in order to thus execute an injection when the injection valve member has lifted up from its valve seat. The annular chamber 27 is connected to a pressure chamber 29, which continuously communicates with a pressure line 30, which is connected to the fuel line 15 of the respective fuel injection valve. The fuel pressure supplied to the high-pressure fuel reservoir 8 also prevails in the pressure chamber 29 and acts there on a pressure shoulder 31 of the fuel injection valve member 21, by way of which the fuel injection valve member can be lifted up from its valve seat in a known manner under suitable conditions. On the other end of the fuel injection valve member, it is guided in a cylinder bore 33 and encloses a control chamber 36 there with its end face 34. The closed position of the fuel injection valve member is controlled by the pressure in the control chamber 36 and also by a compression spring 12 that is supported between the housing 19 and a spring plate 10 of the fuel injection valve member. While the compression spring 12 acting in the closing direction is constant in its characteristic curve, the opening motion and closing motion of the fuel injection valve member are respectively triggered with the aid of the pressure in the control chamber 36. To that end, the control chamber 36 is connected by way of a conduit 37 to a valve 40 that is embodied as a 3-way valve. This valve is shown in more detail in FIG. 3. In this instance, the conduit 37 feeds from the control chamber into a valve chamber 41 in which a closing body 42 of the valve member 43 of the valve 40 is disposed so that it can be adjusted. To that end, the valve member 43 has a tappet 45 connected to the closing body 42. On the closing body, a first sealing face 46 is disposed on its one end face and a second sealing face 47 is disposed on its other end face. The second end face transitions into a connecting piece 48 to the tappet 45, which has a smaller diameter than the rest of the tappet 45 that is guided in a guide bore 50. An annular chamber 51 is formed between the guide bore and the connecting piece 48 of the tappet 45, and a supply conduit 53 feeds into this annular chamber 51. The annular chamber 51 constitutes a through flow conduit between the supply conduit 53 and the valve chamber 41. Oriented toward the valve chamber 41, the guide bore 50 has a diametrically reduced part 52 on which a valve seat 54 is embodied at the discharge of this part of the guide bore 50 into the valve chamber 41, which valve seat cooperates as a second valve seat with the second sealing face 47. Coaxial to this sealing face and to the valve member 43 or the closing body 42, on the opposite end of the valve chamber 41, a first valve seat 55 is embodied, which cooperates with the first sealing face 46. Starting from the valve chamber 41, a discharge conduit 57 leads away from the valve seat 55. This is likewise shown in FIG. 1 and leads back to the fuel reservoir 6 or to an otherwise embodied discharge chamber. A throttle 58 is provided in the discharge conduit and defines the discharge cross section when the valve body is lifted up from the first valve seat 55. The supply conduit 53, which can also be seen in FIG. 1, is connected to the fuel line 15 and can consequently supply fuel from the high-pressure fuel reservoir to the control chamber 36 by way of the valve chamber 41 when the valve member 43 is lifted up from the second valve seat 54.

In this instance, the first and second sealing face 46 and 47 as well as the first 55 and second valve seat 54 are embodied as conical, with a cone vertex angle that is smaller in the first valve seat 55 than the corresponding cone vertex angle of the first sealing face 46, and with a cone vertex angle that is greater in the second valve seat 54 than the cone vertex angle of the second sealing face 47. As a result, upon contact of the second sealing face 47 against the second valve seat 54, a contact line is produced that is determined by the inner diameter of the second valve seat 54 and conversely, upon contact of the first sealing face 46 against the first valve seat 55, a contact line is produced that is determined by the outer circumference of the first sealing surface 46. The actuation of the valve member 43 is carried out by way of the tappet 45 by a drive 59 that is not shown in detail and is embodied as a piezoelectric device, e.g. as a so-called piezoelectric stack or as a magnetostrictive element. These drives have the advantage that they execute adjustment paths that are analogous to the voltage application and in fact, with a high actuation force, even if the absolute path that can be produced is relatively small so that with large adjustment paths, piezoelectric element packets that are also large must be used. The additional advantage of this kind of drive is comprised in that they act very rapidly so that rapid switching operations can be carried out which are highly advantageous, particularly in the field of injection technology.

The forces on the closing body 42 that result from the pressure application by the high-pressure fuel source 8 are significant for the actuation of this closing body 42. This is particularly true in the respective closed positions of the closing body 42. If the closing body 42 is disposed with its second sealing face 47 in contact with the second valve seat 54, then an annular surface RF1 remaining between the diameter of the tappet 45 and the diameter of the connecting piece 48 is acted on by the high pressure of the high-pressure fuel source 8. On the end opposite from this surface, an annular surface RF2 is formed between the connecting piece 48 and the edge of the second valve seat 54 resting against the second sealing face 47. This annular surface RF2 is smaller than the annular surface RF1 so that the forces, which result from the area difference and act on the valve body 42 in the closing direction, toward the end of its drive 59, predominate. These forces hold the closing body 42 in a stable end position against the second valve seat 54. The forces are dimensioned so that the drive 59 can lift the closing body 42 up again from this second valve seat 54 for the opening. If the closing body, in its other position, comes into contact with the first valve seat 55, then stable conditions are in turn produced. It must be assumed that the first circular surface KF1, which results from the diameter of the guide bore 50, can act on the closing body 42 maximally in the opening direction. This circular surface is pressure relieved on the end of the tappet 45 remote from the valve chamber 41.

A second circular surface KF2, which is determined by the contact of the first sealing face 46 against the first valve seat 55, can be maximally effective on the other end. As shown above, the first sealing face 46 rests with its outer circumference against the first valve seat 55 and is in turn pressure relieved toward the end of the discharge conduit 57. The first circular surface KF1 is therefore smaller than the second circular surface KF2 so that the difference of these areas yields a differential area that is loaded by the fuel pressure of the high-pressure fuel reservoir 8 and produces a force that in turn acts in the closing direction of the closing body 42 toward the first valve seat 55. Also, these forces that act in the closing direction are dimensioned so that they can be overcome by the drive 59 of the closing body 42. The respective forces in the stable end positions of the closing body are of such magnitude that they are approximately 40% of the adjusting forces that can be exerted by the drive. As a result, with a required expenditure for the adjusting drive and a corresponding energy requirement, an economical operation of the 3-way valve is possible. Incidentally, in this manner, a drive can be respectively required only for adjusting the closing body. The closing body is held in a stable fashion in the closed position in its respective end positions. As a result, any energy supply to the adjusting drive 59 is omitted for the duration of the closed state. This is of significant advantage for a more reliable, cost-saving operation of the valve.

The foregoing relates to preferred exemplary embodiments of the invention, it being understood that other variants and embodiments thereof are possible within the spirit and scope of the invention, the latter being defined by the appended claims.

We claim:

1. A fuel injection device for an internal combustion engine, comprising a high-pressure fuel source (8) to which a fuel injection valve (14) is attached, said valve has an injection valve member (21) for controlling an injection opening (25), and a control chamber (36), said chamber is defined by a moving wall (34) at least indirectly connected to the fuel injection valve member (21), a supply conduit (53) by way of which a high-pressure source (8) is connected to the control chamber (36), a discharge conduit (57) by way of which the control chamber (36) is connected to a relief chamber (6), wherein the connections mentioned to and from the control chamber can be controlled by way of a valve (40) that has a valve member (43) with a closing body (42) which is provided with two conical sealing faces and can be moved in a valve chamber (41), which closing body is disposed coaxial to two valve seats (54, 55), and depending on the position, comes into sealed contact with the first or second of its sealing surfaces against the corresponding first or second of the valve seats, and the valve chamber continuously communicates with the control chamber (36) by way of a conduit (37), a tappet (45) that is moved by an electrically actuated adjusting drive (59) and is connected to the closing body (42), by means of said tappet, the closing body (42) is moved between the valve seats (54, 55), and said tappet is guided in a guide bore (50) that is connected coaxially to the one of the valve seats (54), wherein a part (48) of the tappet (45) adjacent to the closing body (42) is reduced in diameter and a through flow conduit (51) with an annular cross section is formed between this part of the tappet and the wall of the guide bore (50), which ends at one of the valve seats, and the supply conduit feeds into this through flow conduit and the discharge conduit leads coaxially away from this through flow conduit, adjacent to the other of the valve seats (55), wherein a first annular surface (RF1) that acts in the axial direction of the tappet is formed between the part of the tappet oriented toward the valve chamber and the diametrically reduced part of the tappet (45) and a second annular surface (RF2) that acts in the axial direction is formed between the diametrically reduced part of the tappet and the first sealing edge defined by the placement of the first sealing face against the first valve seat, and that furthermore, the diameter of the guide bore has a first circular surface (KF1) and this circular surface defines a second circular surface (KF2) from the circumference of a second sealing face formed when the second sealing face (47) rests on the second valve seat (54), the forces on the valve member that are produced by the pressure load of the circular surfaces (KF1, KF2) and the annular surfaces (RF1, RF2) are of such magnitude that in the end positions of the closing body (42) at the one or the other of the valve seats (54, 55), a resulting force is produced in the direction of the respective valve seat in the closed position.

2. The fuel injection device according to claim 1, in which the differential area resulting from the difference of the circular surfaces and/or the annular surfaces is of such a magnitude that the resulting forces produced by the high fuel pressure are no greater than approximately 40% of the force that can be exerted by the adjusting drive.

3. The fuel injection device according to claim 1, in which the second annular surface (RF2) is smaller than the first annular surface (RF1) and the first circular surface (KF1) is smaller than the second circular surface (KF2).

4. The fuel injection device according to claim 3, in which the first valve seat is disposed on a diametrically reduced part (52) of the guide bore (50).

5. The fuel injection device according to claim 1, in which the adjusting drive is only supplied with energy for actuating the closing body.

6. The fuel injection device according to claim 2, in which the adjusting drive is only supplied with energy for actuating the closing body.

7. The fuel injection device according to claim 3, in which the adjusting drive is only supplied with energy for actuating the closing body.

8. The fuel injection device according to claim 4, in which the adjusting drive is only supplied with energy for actuating the closing body.

* * * * *